US009542865B2

(12) United States Patent
Simmons

(10) Patent No.: US 9,542,865 B2
(45) Date of Patent: Jan. 10, 2017

(54) THREE-DIMENSIONAL STAND ALONE POP UP ASSEMBLY AND METHOD

(71) Applicant: Dawn Simmons, Grass Valley, CA (US)

(72) Inventor: Dawn Simmons, Grass Valley, CA (US)

( * ) Notice: Subject to any disclaimer, the term of this patent is extended or adjusted under 35 U.S.C. 154(b) by 0 days.

(21) Appl. No.: 14/530,344

(22) Filed: Oct. 31, 2014

(65) Prior Publication Data

US 2015/0135566 A1 May 21, 2015

Related U.S. Application Data

(60) Provisional application No. 61/898,359, filed on Oct. 31, 2013.

(51) Int. Cl.
*G09F 1/06* (2006.01)
*B42D 15/04* (2006.01)

(52) U.S. Cl.
CPC ..... *G09F 1/06* (2013.01); *B42D 15/042* (2013.01)

(58) Field of Classification Search
CPC ..... B42D 15/042; G09F 1/06; A63H 33/38
See application file for complete search history.

(56) References Cited

U.S. PATENT DOCUMENTS 930,108 A * 8/1909 Walcutt ..... A63H 33/38 119/430
953,168 A * 3/1910 Hamilton ..... A63H 33/38 229/92.8
990,918 A * 5/1911 Stadler ..... A63H 33/38 229/92.8
1,386,423 A * 8/1921 Rapson ..... A63H 33/044 446/478
1,844,816 A * 2/1932 Brown ..... A63H 33/38 446/148
2,458,879 A * 1/1949 Schenk ..... A63H 33/38 40/539
3,456,380 A * 7/1969 Cameron ..... A63H 33/38 281/15.1
4,874,356 A * 10/1989 Volkert ..... G09F 1/06 40/124.08
4,885,859 A * 12/1989 Gasser ..... B42D 15/042 40/124.08
5,933,989 A * 8/1999 Volkert ..... G09F 1/06 40/124.08
2004/0031211 A1* 2/2004 Becker ..... E04B 1/3445 52/79.5

(Continued)

*Primary Examiner* — Gary Hoge
(74) *Attorney, Agent, or Firm* — John C. Merchant

(57) ABSTRACT

A three dimensional stand alone pop up assembly and method for making the same, the assembly comprising outer structural wall panels connected with an internal support structure having a spreader, center support element and base components. The assembly moves between a first position, whereby the support structure is folded within the wall panels of the outer structure, and a second position whereby outer structural panels are unfolded into a three-dimensional stand-alone pop-up structure supported in the open position by the internal support structure. The assembly utilizes an internal support structure which folds internally and alleviates the need for an extended base or protruding member. The assembly accommodates a variety of lighting and sound features and can be configured in a variety of three dimensional stand alone pop up designs.

20 Claims, 15 Drawing Sheets

(56) References Cited

U.S. PATENT DOCUMENTS

2008/0149727 A1* 6/2008 Boyd ..... B42D 15/042
235/487
2011/0258892 A1* 10/2011 Taylor ..... G09F 13/04
40/124.02

* cited by examiner 154a, 154b 155a, 155b, 155c,
155d, 155e, 155f

156

THREE-DIMENSIONAL STAND ALONE POP UP ASSEMBLY AND METHOD

CROSS-REFERENCE TO RELATED APPLICATION

The present non-provisional application claims the benefit of commonly assigned provisional Application having Ser. No. 61/898,359 filed Oct. 31, 2013, and entitled THREE-DIMENSIONAL STAND ALONE POP UP ASSEMBLY AND METHOD which application is incorporated herein by reference in its entirety.

FIELD OF INVENTION

The present invention relates generally to three-dimensional stand-alone pop up assemblies and methods for making the same. The assemblies and methods described relate specifically to three-dimensional pop up and fold flat structures such as those traditionally used in greeting cards, books, package decorations, and promotional displays.

BACKGROUND

For the 2012 season, U.S. consumer spending on Christmas decorations was projected to be $6.9 billion dollars and expected to grow by 3.4 percent during the holiday season 2013. In line with the growing number of dollars spent on decorations is also the growing number of articles on how to store holiday decorations. Primary research has unveiled that some consumer collectors of particular holiday items such as the ceramic or pressed paper and cardboard Christmas village sets either keep the village pieces out all year long or unpack them every other year due to the cumbersome task of assembling the village and taking it down each year. Despite the increase in consumer holiday decoration spending dollars, some retailers expressed that selling holiday decor can be a challenge due to direct consumer comments of storage problems. Retailers are also concerned about the amount of retail space required to display particular items (particularly three-dimensional objects and structures).

Typical pop up assemblies, like those used in cards and books, traditionally have an extended gatefold base which extends beyond the footprint of the structure. The structure is positioned along the center line with the walls of the structure glued to the base. When the pop up structure is in a closed position, the extended base is folded along a center line and the structure is folded flat between the sides of the base and is therefore hidden from view. When the base is opened, it pulls on the walls of the structure and pushes up on a vertical center support attached to a horizontal spreader which folds out the walls and makes the pop up structure stand up. The extended base must be held in open position or the pop up will collapse shut. To close the pop up, the extended base is folded shut such that the center support pulls down the spreader allowing the walls to fold closed. The pulling and pushing of the spreader during opening and closing causes stress on the paper walls and, for this reason, the center support requires reinforcement or it will bend or tear over time and use. For this reason, tabs are usually added to the center support and the tabs are folded back and glued to the center support to provide reinforcement and stiffness.

To accommodate the attached walls of the structure and keep the pop in the open position, such prior art pop up structures utilize a large extended base which must be held in the open position by the user (or by placing the structure on a flat surface and applying weighted items on the base ends to hold the extended base in the open position). Otherwise, the elastic nature of the materials will tend to pull the base into a closed position along the center line causing the center support to move downward and fold the walls.

Another drawback of prior art pop up structure is that when the structure is in closed position it is entirely hidden from view by the extended base. This creates is a problem for consumers who must rely on photographs of displays in order to determine the indicia and other design amenities of the structure prior to opening (or purchasing). Further, the consumer may not want an extended base but rather have a pop up structure which can stand alone on a shelf or otherwise be hung from a line. The extended base also prevents the user from displaying several pop up structures adjacent to one another as there must be room to accommodate the base of each structure. While there are a variety of foldable stand-alone structures (made of card stock or other materials) which may lay flat when disassembled and otherwise be pieced together into a three dimensional stand up structure without an extended base, such assembled prior art structures are not pop up structures in that they cannot be easily moved between a closed substantially flat position and an open three dimensional position without constructing and deconstructing the structure. For example, a prior art structure having multiple panels and base may be constructed to stand alone or deconstructed to fold flat, but it does not move easily between the two positions without considerable effort on the part of the user.

Examples of prior art pop up structures which do not use the extended base approach include that described in U.S. Pat. No. 8,418,384 (First Inventor Jin, granted Apr. 16, 2013) as a pop up musical greeting card using a top extended center support mechanism to activate a musical sound module and/or lights when in the open position. While this design eliminates the problems associated with the extended base, it requires that the center support member (or mechanism) to protrude outward and extend away from the structure. This protruding extended support is not aesthetically pleasing or consistent with the design theme.

Again, the disadvantages of the prior art pop up structures are numerous in that they either rely on an extended base which must be held open and/or a protruding extended support member which is unsightly. Such extended bases or protruding members require additional space to display and to store. They do not allow for the user to view the exterior aesthetic features of the structures when in the closed position because they are covered by the extended base or card cover when closed thus making it difficult for a user to sort and/or identify items folded flat in a box or other container. They have limited lighting options because lighting must be made small enough to allow the structure to fold flat when in the closed position and/or there is no accommodation in the center support or base to allow a tea light or other larger lighting object to be placed in the structure. The lighting option described in the Jin patent (identified above) is particularly limited in size and duration of light (lasting only 10 to 20 seconds in the open position), and cannot be easily replaced. In fact, most prior art pop up structure designs make no accommodation whatsoever for internal lighting. Those relying on candles tend to be a fire hazard because there is no accommodation within the center support structure or base to hold the light away from flame. The very nature of most prior art designs, which tend to collapse unless the extended base is held open, is unsafe for use with open flame. Those relying on temporary battery powered lighting are limited by space within the structure.

What is needed is a stand alone pop up structure (or "assembly") which does not rely on an extended base or protruding extended support member and which alleviates other disadvantages associated with the prior art.

SUMMARY OF INVENTION

In accordance with the present invention, a three dimensional stand alone pop up assembly and method for making the same is provided which resolves problems associated with prior art. The assembly consists, generally, of an outer structure comprising two or more wall panels connected with an internal support structure having a spreader, center support and internal base components. The assembly moves between a first (substantially closed) position, whereby all the of the outer structure and internal support structure are folded substantially flat with the internal support structure lying between the wall panels of the outer structure, and a second (open or three dimensional) position whereby outer structural panel walls are unfolded into a three-dimensional stand-alone pop-up structure supported in the open position by the internal support structure. The assembly utilizes an internal support structure which folds internally and alleviates the need for an extended base or protruding member. The overall assembly accommodates a variety of lighting and sound features and can be configured in a variety of three dimensional stand alone pop up designs.

DETAILED DESCRIPTION OF THE PREFERRED EMBODIMENTS

The Figures are for purposes of illustrating several embodiments of a pop up assembly consistent with the principles of the present invention and are not for purposes of limiting the same.

Figure 1A:
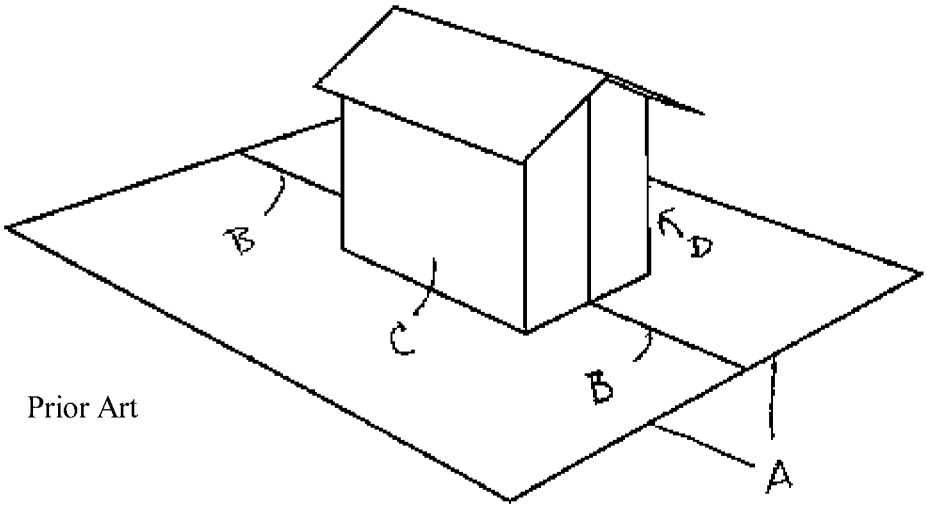
FIGS. 1A-1C are perspective views of an example embodiment of a traditional prior art pop up assembly in the shape of a house moving from an open second positon toward a substantially closed first position.
Figure 1B:
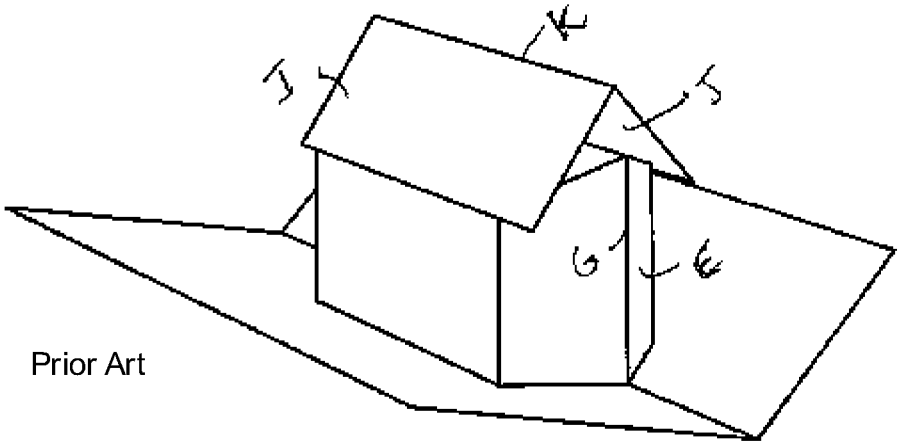
Figure 1C:
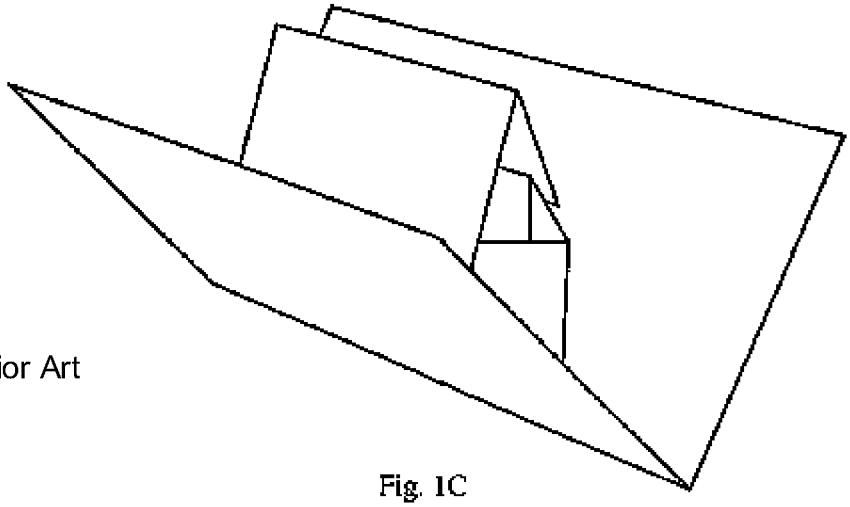
Prior Art Fig. 1C

FIGS. 1A-1C are perspective views of an example embodiment of a traditional prior art pop up assembly in the shape of a house moving from an open second positon toward a substantially closed first position. Like those assemblies traditionally used in cards and books, the assembly has an extended two-panel gatefold base (A) with a single center fold line (B). The bottom edge of the opposing front (C) and back (D, not shown) wall panel are glued to the top surface of the base (A) and the structure folds open (i.e. pops up) when the base is opened. The gatefold base and center fold line found in pop up books may also include bindery. FIG. 1A shows the assembly in the open second position. FIGS. 1B and 1C shows the assembly with the extended base folding along the center fold line (B) toward a substantially closed first position. Sidewalls (E) and (F, not shown) folds outward at their respective center fold lines (G and H). The roof panels (I and J) collapse together along the roof center fold line (K)

Figure 2A:
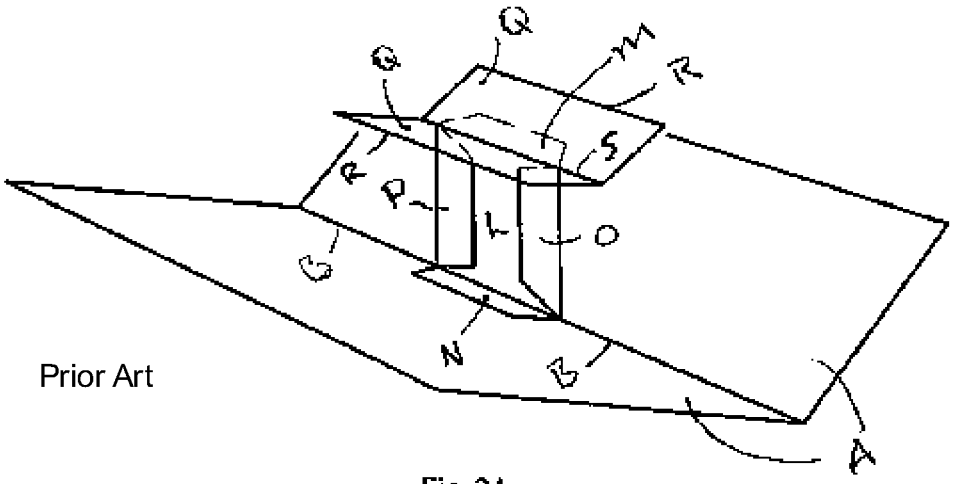
Prior Art Fig. 2A
FIG. 2A is a perspective view of the structural elements of an example embodiment of the traditional pop up assembly depicted in FIGS. 1A-1C.
Figure 2B:
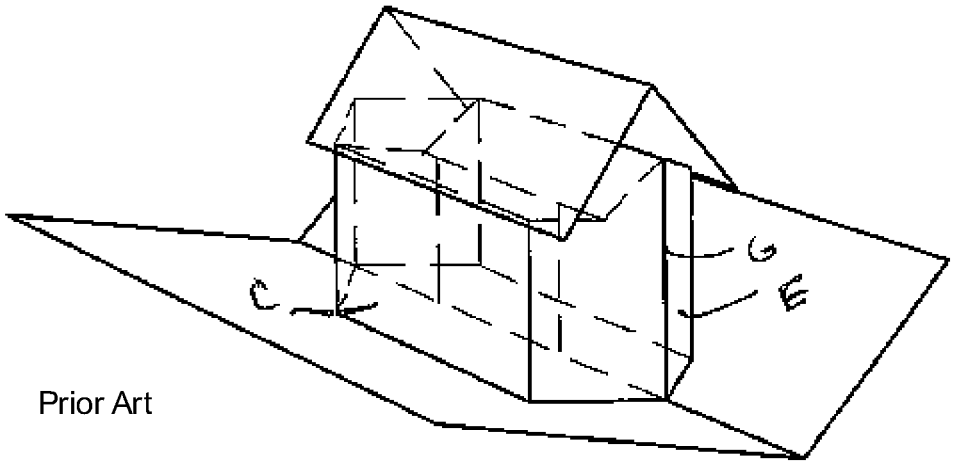
Prior Art Fig. 2B
FIG. 2B is a perspective view of the traditional prior art pop up assembly depicted in FIGS. 1A-1C with both internal and external elements shown.

FIG. 2A provides a perspective view of the mostly internal structural elements of the example embodiment of a traditional prior art pop up assembly (as depicted in FIGS. 1A-1C) while FIG. 2B is a perspective representation of those structural elements in relationship to external elements (such as the panel walls and roof). Note that not all the elements depicted in FIG. 2A are internal. The extended base (A) extends beyond the outer boundaries of the outer structure walls (or panels) when in the open position and otherwise serves to envelope (sandwich or hide) the other elements, including the wall panels, when the assembly is in the first closed position.

The internal structural elements shown in 2A include the two panel extended gatefold base (A) having left and right sides which fold together along the center fold line (B), a center support member (L) having glue tabs (M and N) and reinforcement tabs (O and P), and a spreader (Q) having left and right flaps each side having an outboard edge (R). In the example shown, the extended base (A) has a single (in this case a center) fold line (B) defining the two equally sized sides. The spreader (Q) also has a center fold line (S) defining two equally sized flaps. One of the center support element glue tabs (N) is attached to the extended base immediately adjacent the base center fold line (B). The other center support glue tab (M) is attached to the spreader (Q)

immediately adjacent the spreader center fold line (S). As shown in FIG. 2B, each side of the extended base (A) is attached to the bottom edge of opposing panel walls (C and D, not shown). The outboard edges of the spreader flaps are attached with the interior surface of opposing panel walls (C and D) of the outer structure while the remaining two walls (E and F, not shown) each have center folds (G) which allow the outer structure to collapse when the assembly is in the closed position. When the structure is in an open position (referred to herein as the "second" position—See FIG. 1A), the two sides of the extended base (A) are pulled into horizontal alignment with one another. When the structure is in a closed position (referred to herein as the "first" position—as substantially shown in FIG. 1C), the two sides of the extended base (A) are folded together along the base center fold line (B) so they are substantially parallel and overlap one another with the outer structure folded flat in between.

When the extended base (A) is pulled open (i.e. moved from first to second position), the center support element (L) which is substantially perpendicular to the base moves upwards relative to panel walls of the structure, thus pushing open the spreader flaps (Q) connected with the opposing walls. When the extended base (A) is folded closed (i.e. moved from second to first position), the center support (L) is pulled downward relative to the walls of the outer structure which in turn causes the spreader flaps (Q) to fold inward and collapse the structure. This pulling and pushing of center support against the spreader and spreader flaps against the walls of the structure during opening and closing causes stress to the center support element (as well as to the joints or connections) and, for this reason, the center support, spreader and connections often require reinforcement or they will bend or tear over time and use. For this reason, support tabs (O and P) are usually added to the center support and these tabs are folded back and glued to the center support element (L) providing reinforcement and stiffness. As previously noted, the extended base (A) must be held in the open position or the pop up will collapse shut as the elasticity of the materials along the center folds will cause the structure to collapse inward rather than extend outward.

Figure 3A:
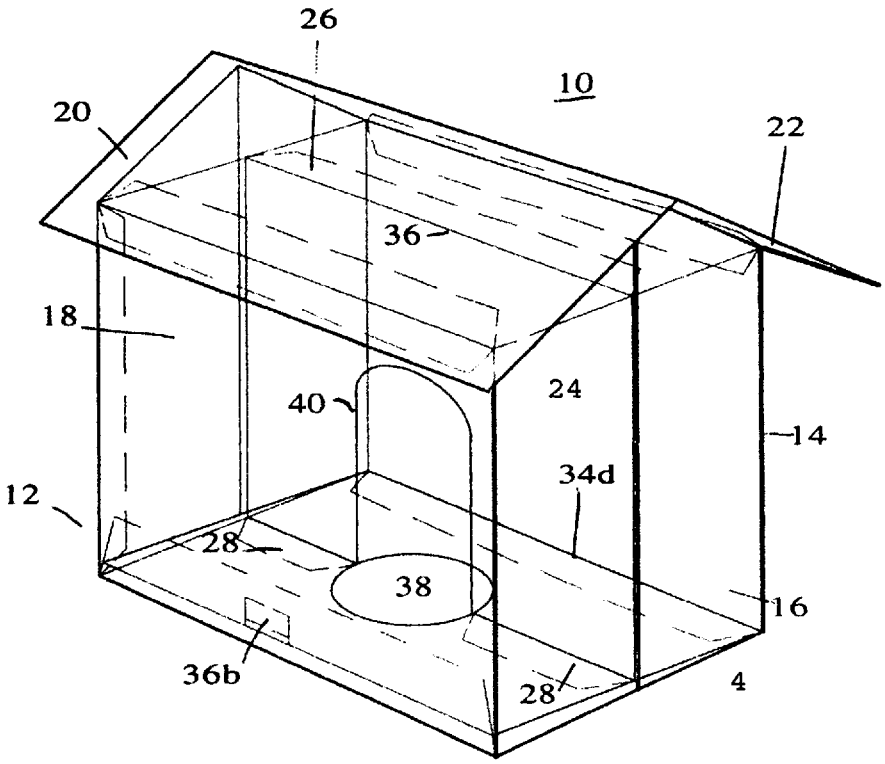
FIG. 3A is a perspective view of an embodiment of a pop up assembly consistent with the principles of the present invention in the form of a house.
Figure 3B:
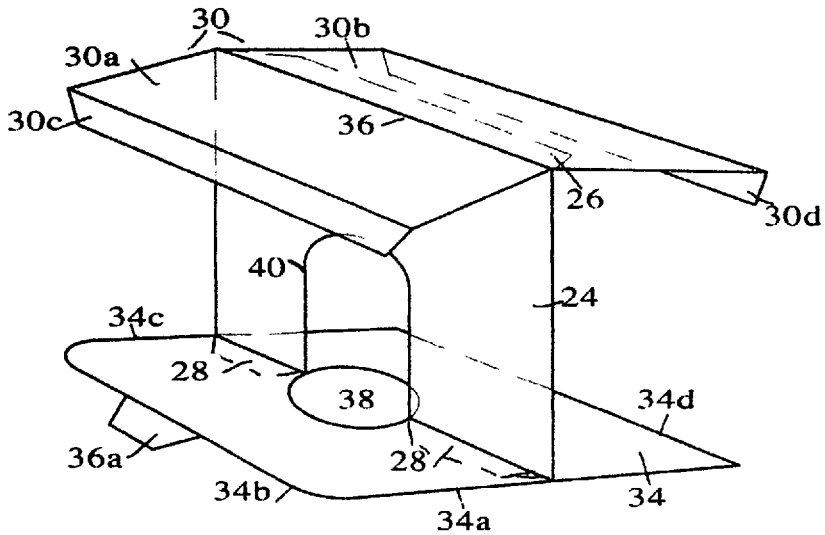
FIG. 3B is a perspective view of the internal structural elements of a pop up assembly consistent with the principles of the present invention.

FIG. 3A is a perspective view of an example of preferred embodiment of a pop up assembly 10 in the form of a house which is consistent with the principles of the present invention. FIG. 3B is a perspective view of the support structure of the assembly, while FIG. 3A shows outer structure with the support structure elements contained therein. Looking at FIG. 3A, the outer structure elements consist of opposing front 12 and back 14 panel walls, side walls 16 and 18, as well as well as roof flanges 20 and 22 each having interior and exterior surfaces and generally connected as a single piece of material or by way of glue tabs or other connection means. Looking at FIG. 3B, the support structure includes a center support member 24 having front and back sides, a top edge glue tab 26, a bottom edge glue tab 28, a spreader 30 having a center fold line 36 defining two spreader flaps (30*a* and 30*b*) each having one or more outboard edge flaps (30*c* and 30*d*), and an internal base 34 having top and bottom sides, three or more edges (34*a*, 34*b* and 34*c*), and anchoring means 36 (in this case a tab 36*a* extending from the internal base 34 configured for insertion into a corresponding slot or pocket (see 36*b* on FIG. 3A) located at or near the bottom edge of one or more front, back or side walls of the outer structure.

As shown in FIG. 3A, the outboard edges 30 of the spreader flaps (30*a* and 30*b*) are connected at with the interior surfaces of opposing front 12 and back 14 wall panels. The top edge glue tab 26 of the center support 24 is connected with the bottom surface of the spreader 30 adjacent the spreader fold line 36. There are various options for connecting the bottom edge of the center support 24 with the internal base 34. For example, the bottom edge of the center support 24 may be connected with the top surface of the internal base 34 by way of a bottom edge glue tab 28 (as shown in FIG. 3A) or, alternatively, the bottom edge of the center support 24 can extend to form the internal base (making the center support 24 and internal base 34 a contiguous piece) One or more of the three or more edges of the internal base 34*a*, 34*b* and 34*c* are connected with or, preferably, extends into one or more anchoring means (such as tab 36*a*) configured for insertion into a corresponding anchoring means (such as slot 36*b*) located at or near the bottom edge of one or more front, back or side walls of the outer structure.

Note that the example embodiment shown in FIG. 3B, has a single tab 36*a* extending from an edge 34*b* of the internal base corresponding with the front panel wall 12 of the house structure. This anchoring means keeps the internal base anchored in a perpendicular orientation to the wall panels when the assembly is in the open second position. The opposite edge of the internal base 34*d* is permanently (through glue tab or other equivalent means) or temporarily (through tab and slot or other equivalent means) anchored at the base of the back panel wall 14 of the outer structure. When the assembly moves from the open position to the closed position, as later described, the anchoring means on one or both sides will be disengaged to allow the internal base to tilt and fold up into the outer structure. In a preferred embodiment, as shown in FIGS. 3A and 3B, edge 34*b* of the internal base is permanently connected with the base portion of the back panel wall 14 of the outer structure thus creating a hinge upon which the internal base folds when the assembly is closed.

It should also be noted that the internal base 34 is made of "heavier" or "weighted" materials such as heavy card stock, sheet plastic or equivalent material so that the stresses caused by the elasticity along fold lines and connections between other elements does not cause the base to break or crease but will instead maintain a relatively flat shape during and after use. If the internal base is made of light card stock, it is likely to fold, break or warp after multiple uses.

Figure 4A:
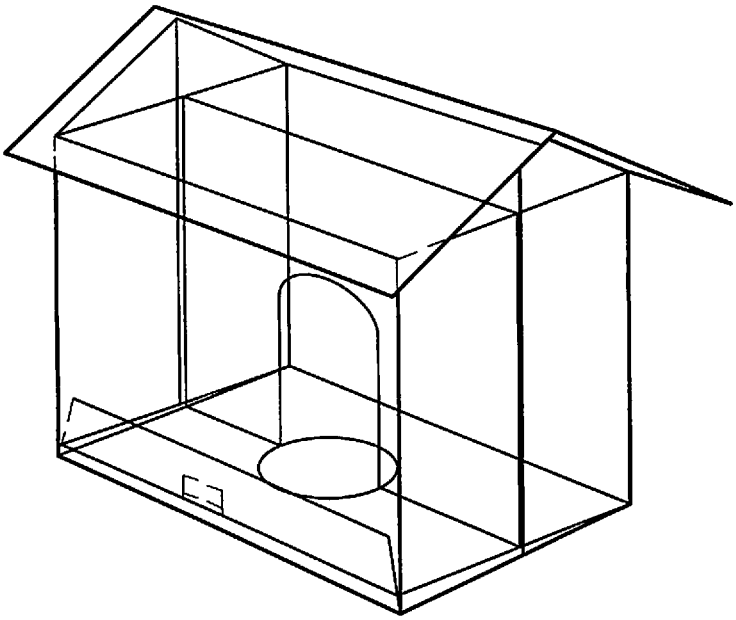
FIGS. 4A-4C are several views of a preferred embodiment of a pop up assembly consistent with the principles of the present invention in the form of a house. The several views show the internal structural elements relative to external elements as the assembly moves from a second open position to a closed first position.
Figure 4B:
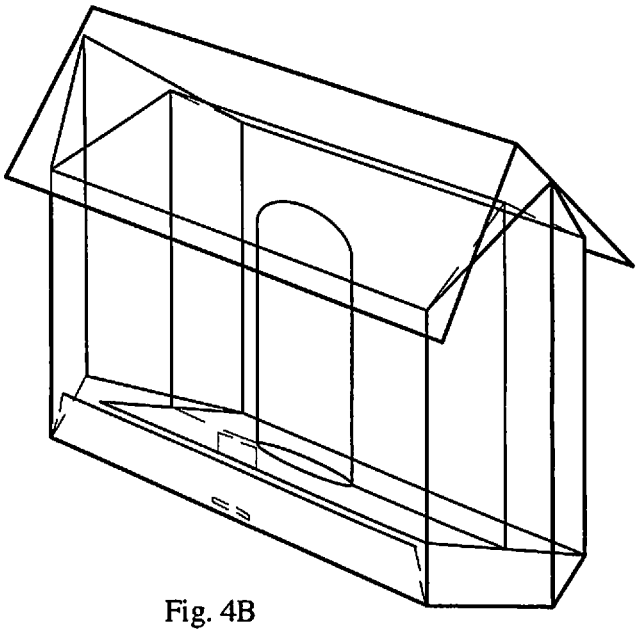
Figure 4C:
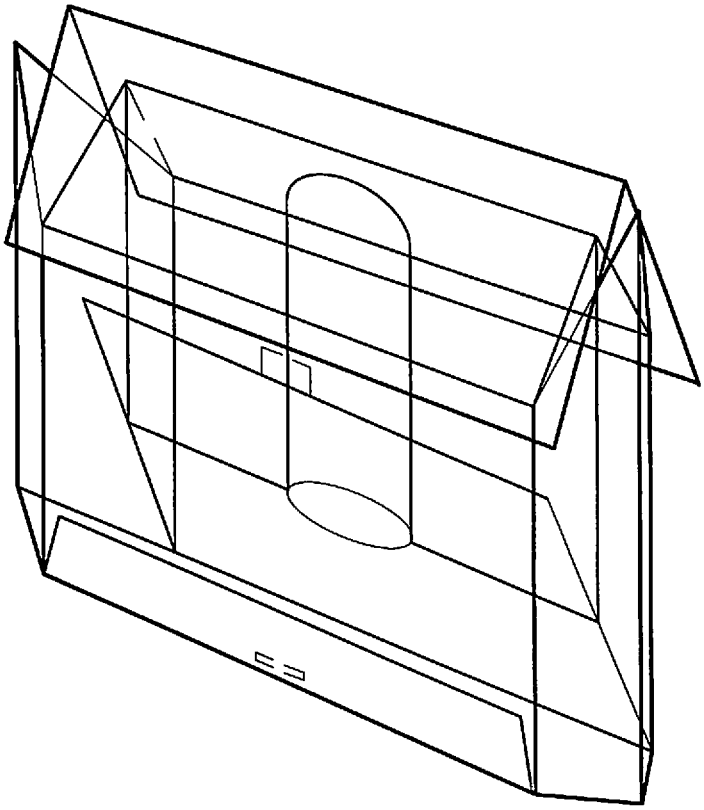

FIGS. 4A-4C are perspective views of the example embodiment of the pop up structure shown in FIG. 3A moving from an open second position to a substantially closed first position. FIG. 4A shows the embodiment in second open position. To closing the assembly, the anchoring means (in this case tab 36*a* removed from slot 36*b*) disengaged and the internal base 34 is tilted such that edge 34*b* extend up into the assembly parallel with the center support element 24 and between the opposing panel walls (see FIGS. 4B and 4C). As shown, the internal base 34 is attached with the center support 24, the center support being attached by glue tab 26 with the spreader 30, the two spreader flaps 30*a* and 30*b* being attached to interior surfaces of opposing front 12 and back 14 panel walls via spreader outboard edge tabs 30*c* and 30*d*. As the internal base 34 is pushed up into the structure, the center support 24 moves upward collapsing the opposing spreader walls (30*a* and 30*b*) inward to the closed (first or "folded flat") position. To open the assembly (i.e. move the structure from the first position to second position), the internal base 34 is pulled downward, tilting on the hinge at edge 34*d* into a horizontal position relative to the vertical center support 24 and secured by anchoring means 36. The downward tilting motion of the internal base pulls down on the center support 24 which, in turn, causes the spreader flaps (30*a* and 30*b*) to push the opposing front 12 and back 14 walls outward and into the open (second) position. (See FIG. 4A).

Importantly, the motion of the center support member 24 during the opening and closing of the assembly is in the opposite direction to the motion the center support member L takes to open and close the traditional prior art pop up structures (where the center support member L is moved upward to cause the spreader to push open the walls and downward to cause the spreader to close the walls). The combination of the heavy card stock center support connected with a heavy (or reinforced) internal base with anchoring means enables the inventive assembly to open and stand-alone without the aid of an extended base or protruding extended members. The inventive assembly does not distribute as much stress on the center support member therefore eliminating the need for center support tabs (O and P). Further, that the internal base moved up into the outer structure makes the assembly smaller and allows the user (or consumer) to see the exterior features of the assembly when in the closed position.

Figure 5A:
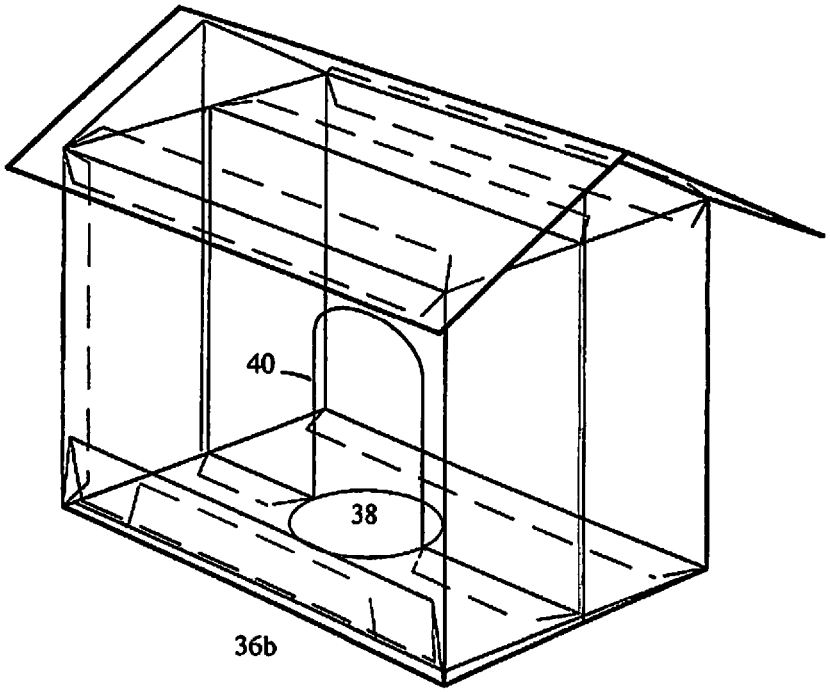
FIG. 5A is a perspective view of an alternative embodiment of a pop up assembly consistent with the principles of the present invention in the form of a house.
Figure 5B:
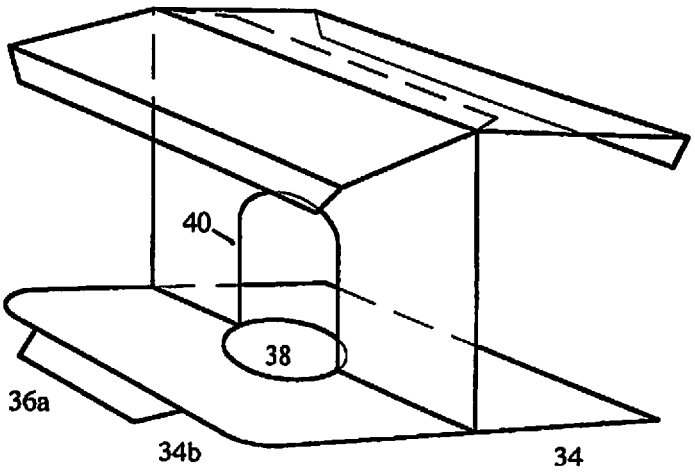
FIG. 5B is a perspective view of the internal structural elements of an alternative embodiment of a pop up assembly consistent with the principles of the present invention.
Figure 5C:
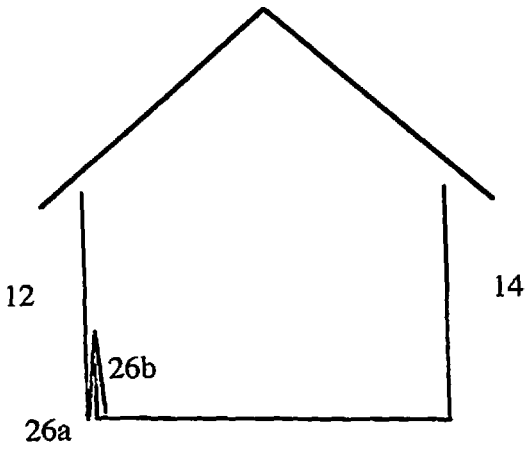
FIG. 5C is a side cutaway view of an alternative embodiment of a pop up assembly highlighting the alternative locking mechanism shown in FIGS. 5A and 5B.

FIGS. 5A-5C show perspective views of an example embodiment of the assembly similar in design to that of FIGS. 3A and 3B but with an alternative anchoring means. Looking at FIGS. 5A and 5B, the alternative anchoring means consists of an elongated tab 36*a* extending from edge 34*b* of the internal base 34 (see 5B) which is positioned within a pocket 36*b* (see 5A) located at the base portion of the interior surface of the front 12 panel wall. This pocket may be fashioned by way of folding an extended bottom portion of the front 12 panel wall and securing it with the interior surface of the wall at the ends thus creating a pocket (space) in which the extended tab 36 may be easily secured. FIG. 5C is a cut away side view of the assembly showing tab 36*a* positioned within the pocket 36*b* created by the folded extended panel wall 12.

There are a variety of options for anchoring the internal base 34 in the open position. In alternative embodiments (not shown) multiple corresponding slots may be cut into the side walls to accept the one or more anchoring tabs extending from the internal base. A combination of tab and pocket anchoring means may be utilized with the goal being that the internal base 34 is temporarily secured such that the assembly is held open without relying on an extended external base being held open as us required with the traditional pop up structure (shown in FIG. 1A). Again, anchoring pockets or slots may positioned at the base portion the wall panels which correspond to tabs extending from the internal base. In other embodiments, an equivalent form of anchoring mechanism may be employed to temporarily lock the internal base in position, for example hook and loop, snaps, temporary glue tabs (i.e. sticky tabs) or other options known in the industry. In some alternative embodiments, the internal base may extend beyond the sides of the house structure but, in order to assure that the base (internal and external) may tilt and slide up into the interior of the assembly when in closed position, the internal may not extend beyond the side walls. Although the present invention is designed to eliminate the need for an extended base to keep the structure in open position, the present invention may otherwise utilize or sit within a larger base when desired. For example, one or more structures may sit within a larger base that provides an aesthetically pleasing foreground or background (such as in a Christmas scene) or to provide a base for positioning of multiple structures (houses positioned on a hill, for example).

The internal base and center support elements shown in the figures are configured to accommodate replaceable internal lighting, such as tea lights, battery powered lights and the like. For example, the embodiments shown in FIG. 3A-3B, 4A-4C, and 5A-5B have a round cut out 38 in the internal base with round cut out in the corresponding external base large enough to fit the circumference of a round tea light. The center support 24 has an arch shaped 40 cut out to accommodate the height of a small light or bulb. When the structure is in the open position, the tea light may be placed therein without worry that a hot element or bulb will burn or otherwise compromise the structure. These lighting components may be easily replaced or removed when the structure is to be closed. Likewise, various electronic components may be accommodated by the inventive assembly such as electronic components used to play sound, activate lights or perform other special effects or a combination thereof. Electronic components may include, but are not limited to LED lights, a printed circuit board with microprocessor, an integrated circuit ship, a controller, a power source, a speaker, a switch, a memory device, and one or more digital files stored on the memory device. Further, because the inventive structure does not need an extended base to stay open, accommodation can easily be made for hanging as an ornament or as another type of hanging decoration. For example, an assembly may include a hook or holes designed for stringing. For such purpose, the base may be solid with or without internal access flap.

Figure 6:
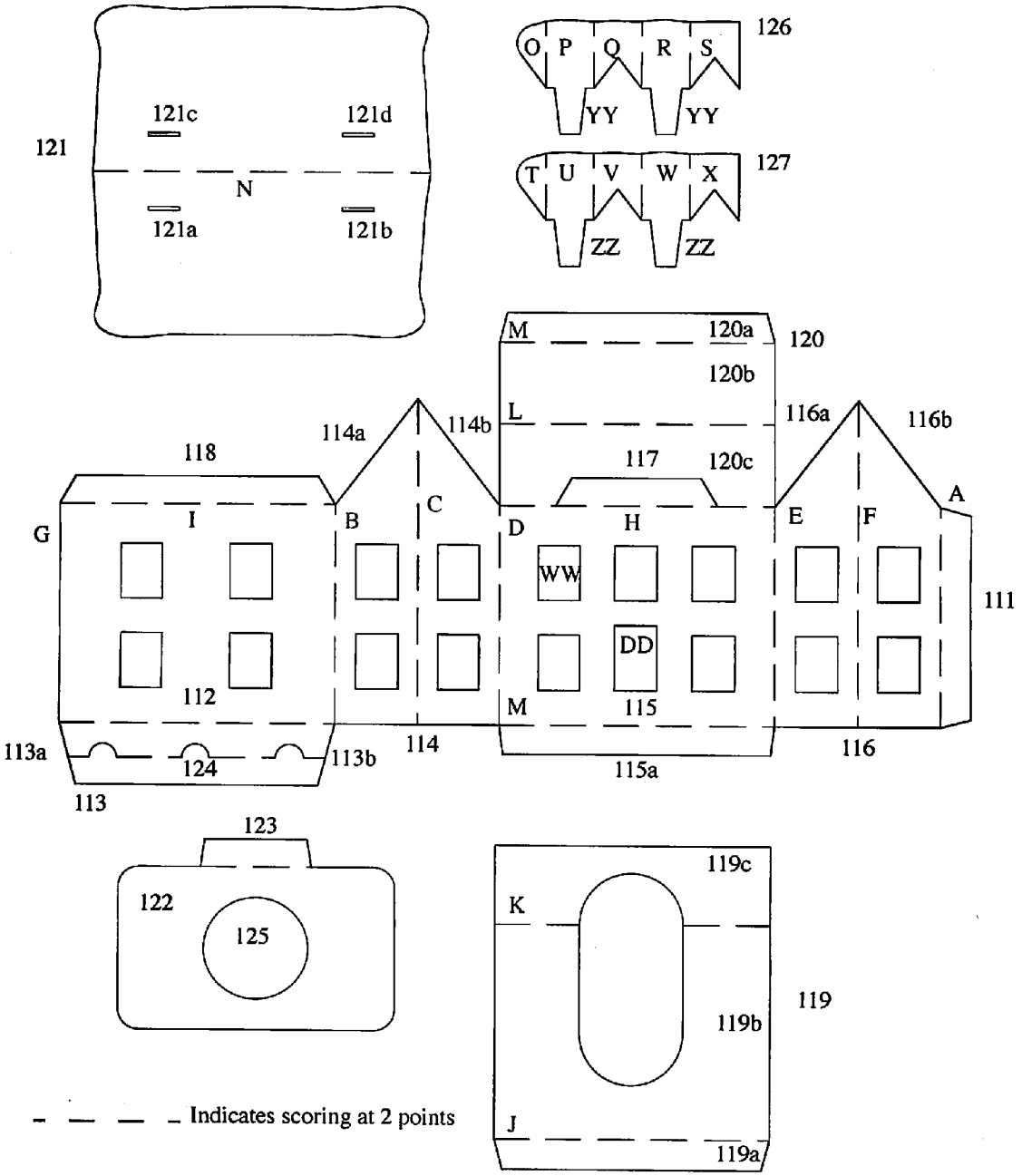
FIG. 6 is an example template showing the design and shape of the various elements associated with a first example embodiment of a four-panel pop up assembly consistent with the principles of the present invention in the shape of a house.
Figure 6:
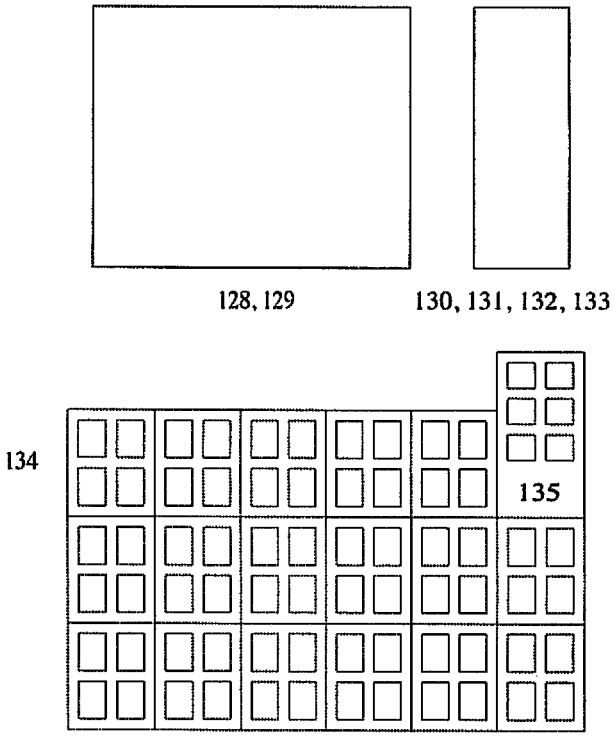

FIG. 6 shows a stencil outlining the elements of an example four-panel paper pop up assembly consistent with the principles of the invention and in the form of a house. The various elements are marked as follows:

111 (back wall panel side glue tab)
112 (back wall panel)
113 (back wall panel bottom back glue tab with slot for locking tab)
114 (left side wall panel)
114*a* (left of left side wall panel)
114*b* (right of left side wall panel)
115 (front wall panel)
116 (right side wall panel)
116*a* (left of right side wall panel)
116*b* (right of right side wall panel)
117 (front wall panel top glue tab)
118 (back wall panel top glue tab)
119 (center support member with two scores and two glue tabs)
120 (spreader with center score and one glue tabs)
121 (roof top with center score)
122 (internal base)
123 (anchoring tab)
124 (anchoring slot)
125 (rounded opening for battery operated tea light)
126 (chimney)
127 (chimney)
128, 129, 130, 131, 132, 133 (internal vellum pieces)
134 (exterior window overlays)
135 (exterior door overlay)
G (end of back wall)
A, B, C, D, E, F, H, I, J, K, L, M, N (score or fold lines)
O, P, Q, R, S, T, U, V, W, X (wall sections of chimneys)
YY, ZZ (chimney tabs into roof 21)
- - - - - - Indicate scoring at 2 points Note that there are a variety of methods and materials known and used in art to attach elements to each other such as hot glue, craft glue, spray adhesives, tape, gels, magnets, staples, hook and loop (i.e. Velcro) and other adhesive substances or fasteners. Glue is a preferred adhesive as it is very effective and does not deteriorate like tape over time. Velcro is an option for use in the tab slot closure.

One example of a method for making the structure shown in FIG. 6 consists of the following steps:

Tabs 113*a* and 113*b* folded to the inside of 112 and secured. Vellum 128 and 129 are attached to the interior surface of wall panels 112 and 115. Vellum 130, 131, 132, and 133 are attached to the inside of left side wall panel 114*a*, 114*b*, and right side wall panel of 116*a*, 116*b*. Center support member tab 19*c* is lined up and attached to the bottom tab 115*a* of front wall panel 115. Internal spreader is a continuation of front wall panel 115 consisting of die cut tab 117, scores L and M. Tab 120*a* is aligned with score I at score M with the narrow portion of 120*a* score M facing down towards the base of 112. Tab 120*a* is attached just below score I. Tab 119*a* at score J is aligned and attached to just off center of score L on side 120*b*. The method of attaching in this sequence and just off center to score N is important to the proper function of the internal parts.

Positioning the center support member to just off center of the center fold on the spreader allows the spreader to fold correctly when in the first folded flat position. Since the spreader needs to fold in an upward arch when placed in the first folded flat position, this off-center-to-score attachment avoids any binding or hindrance that could be created if the attachment were at the spreaders exact center. The just off center placement design of the center support member attachment to the spreader allows the pop up to fold flat while still functioning as needed when in the second open position.

Base 122 is attached to section 119*c* on internal center support leaving one-half of the base unit unattached. Tab 111 is attached to the inside of 112 at G with score A lined up directly to the right edge of G. Tab 117 is lined up to score marks on the inside of roof 121 located just below 121*a* and 121*b*. While in this position, adhesive is applied to tab 117 and attached. Adhesive is then applied to tab 18 and attached in the same manner to the score lines on the inside and just below 121*c* and 121*d*.

Chimney 126 is folded on the score lines with adhesive applied to section O and attached to the inside of section S to make a square. Similarly, chimney 127 is folded on the score lines with adhesive being applied to section T and attached to inside of section X to make a square. Chimney tabs YY and ZZ are inserted into roof 121 at slots 121*a*, 121*b*, 121*c*, 121*d*.

The seventeen overlay windows 134 in FIG. 6 continued are lined up precisely and adhered to the exterior structure at the designated window openings WW.

The door 135 is lined up precisely with the door opening DD on the front of wall 115 creating a polished framed effect.

Wall 112 acts as an anchor for 113*a* and 113*b* which collectively create the pocket-slot design 124. Base tab 123 tabs into the slot created by the combined attachment of 113*a* 113*b* to wall 112.

Importantly, the inventive design requires only one wall of the outer structure to be connected to the internal base of the support structure in order to function as a complete and independent unit as a three-dimensional stand alone structure in the open position and as a complete and independent unit as a flat object in the second closed position. The prior art designs (for example, that shown in FIG. 1B) require that opposing walls of the assembly be connected to the extended base in order to cause the center support mechanism to move up and down when the structure is opened and closed. The unique design of the inventive assembly effectively eliminates the need for a double wall attachment at the outer structure or an extended base to assist in opening the structure. Elimination of the extended base allows for the aesthetic features of the assembly to be viewed when in the first folded flat position (i.e. when stored), and also allows the assembly to function as a self-contained stand alone object when in the second open position.

Figure 7:
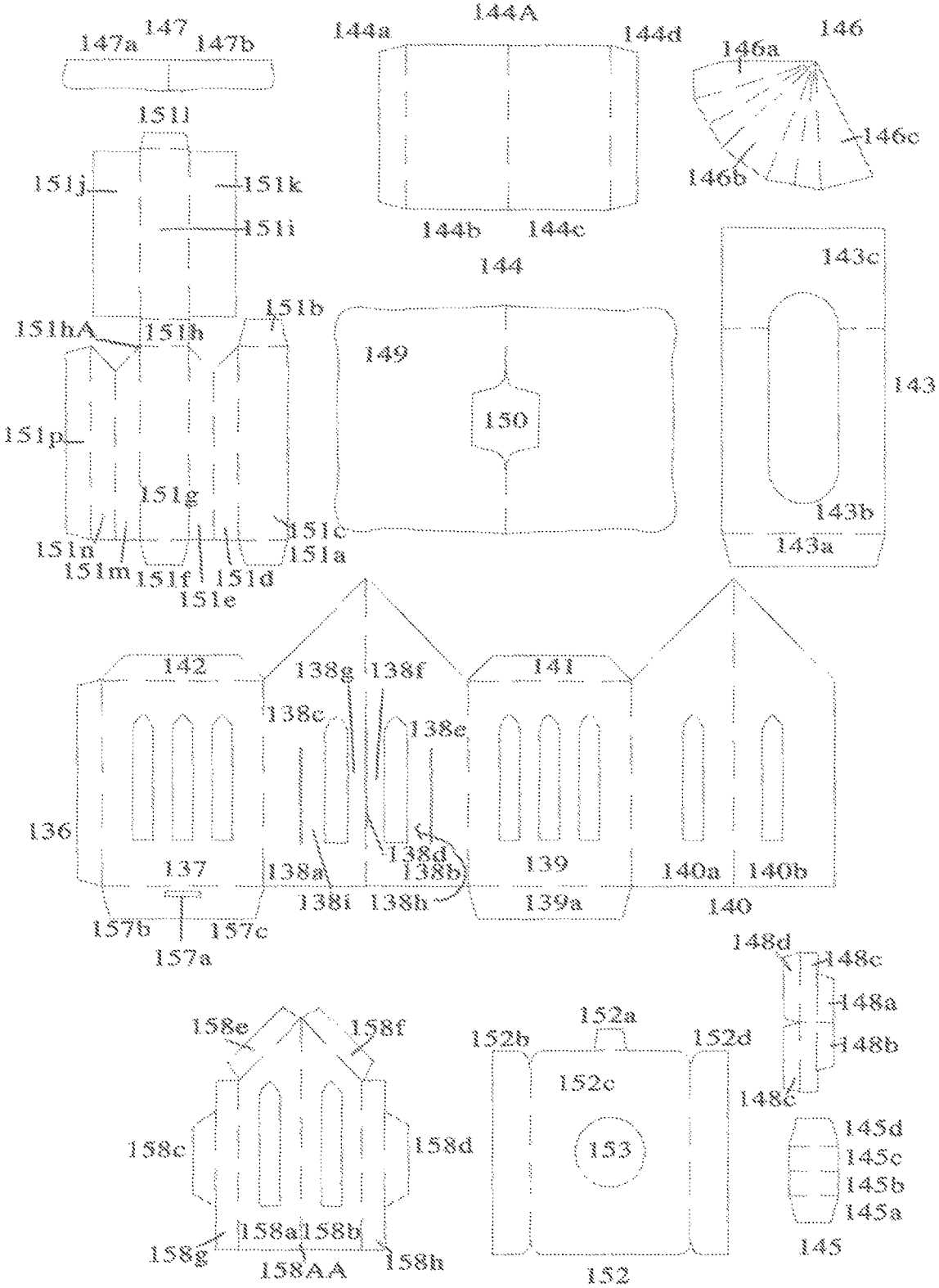
FIG. 7 is an example template showing the design and shape of the various elements associated with a second example embodiment of a four-panel pop up assembly consistent with the principles of the invention in the shape of a church.
Figure 7:
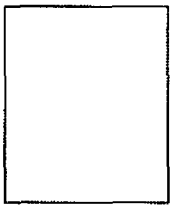
Figure 7:
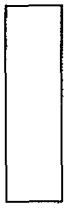
Figure 7:
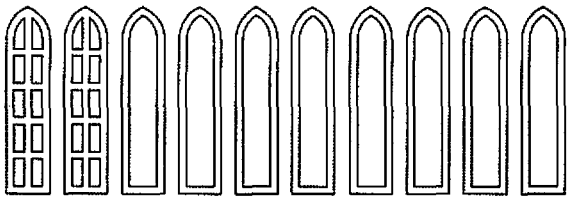

FIG. 7 shows an alternative embodiment of the four-panel paper pop up structure that is consistent with the principles of the invention. The assembly is completed in a similar manner regarding the example embodiment shown in FIG. 6 with the following variation of the internal base being attached to the right side wall panel 139 with the tab slot on the left side wall panel 137. The assembly is completed in a similar manner to the example embodiment shown in FIG. 6 with the following additions: an added front portico 158 with roof 147, and an added tower 151 with steeple 146.

Before assembling the structure, attach two pieces of vellum 55 to inside window openings at back wall panel 140 at openings at 140*a* and 140*b*. Attach additional vellum to inside front windows of portico at window openings at sides 158*a* and 158*b*. Attach remaining vellum 154 to interior surface of the side wall panels left 137 and right 139 at window openings. Attach tab 157*b* and 157*c* to interior surface of the left side wall panel 137 leaving 157*a* and area to the top and bottom of 157*a* void of any adhesive. To assemble the portico to the structure, slip portico support tab 148*a* and 148*b* into front wall panel center slot 138*d*. Split tab and attach 148*a* to inside of 138*g*. Attach 148*b* to inside 138*f*. Insert portico tab 158*d* into front wall panel slot 138*e* and attach to inside 138*h*. At inside center portico score (158AA) attach tabs 148*d* and 148*e* in opposite directions so that 148*d* is attached to interior surface of wall panel 158*a* and 148*e* is attached to interior surface of wall panel 158*b*. Note the tabs will not be attached exactly at the score line. When the front wall panel 138 is folded with the attached portico tab 158*d* in place, the center portico support tabs will align with the front portico in the proper position. This may be 0.031-0.0625 of an inch off center score.

Continue assembling the portico by inserting tab 158*c* into front wall panel slot 138*c* and attaching 158*c* to the interior surface of wall panel 138*i*. Add portico roof 147 by attaching roof tab 147*a* to portico tab 158*e* and roof tab 147*b* to portico tab 158*f*. Assemble the remaining structure in the manner described with regard to FIG. 6 omitting the roof until the tower is assembled.

The tower assembly is completed in the following manner and offers additional dimensionality unlike the prior art with an additional internal support structure found in part 145. To begin, attach tower tab 151*j* to tower tab 151*k*. Attach tower tab 151*l* to underside tower support 145*c*. Fold tower back away and up at score 151*h*A. Attach 145*d* to inside back of 151*g* approximately 1.125 inches from the top of tab 151*f*. Fold tower tab 151*p* and attach to tower support tab 145*a* with the right edge of 151*p* lined up to the center of 145*a*. Fold tower tab 151*c* line up to fold between tower tabs 151*n* and 151*p* attaching 151*c* to remaining half of tower support tab 145*a* and all of 151*p*. Assemble steeple (146) by attaching 146*a* to back side of 146*c* lining up the right side of 146*c* to the score at 146*a*. Line up tower tabs 151*a* and 151*f* to bottom of steeple wall panels 146*b* and 146*c* and attach. To attach tower to center support spreader (144), attach tower tab 151*b* to center top of 144*c* just to right of score 144A and attach tower tab 151*h* to center top of 144*b* just to left of score 144A. To attach roof to structure, place tower 151 through the hole at 150 and attach as described with regard to FIG. 6.

Figure 8:
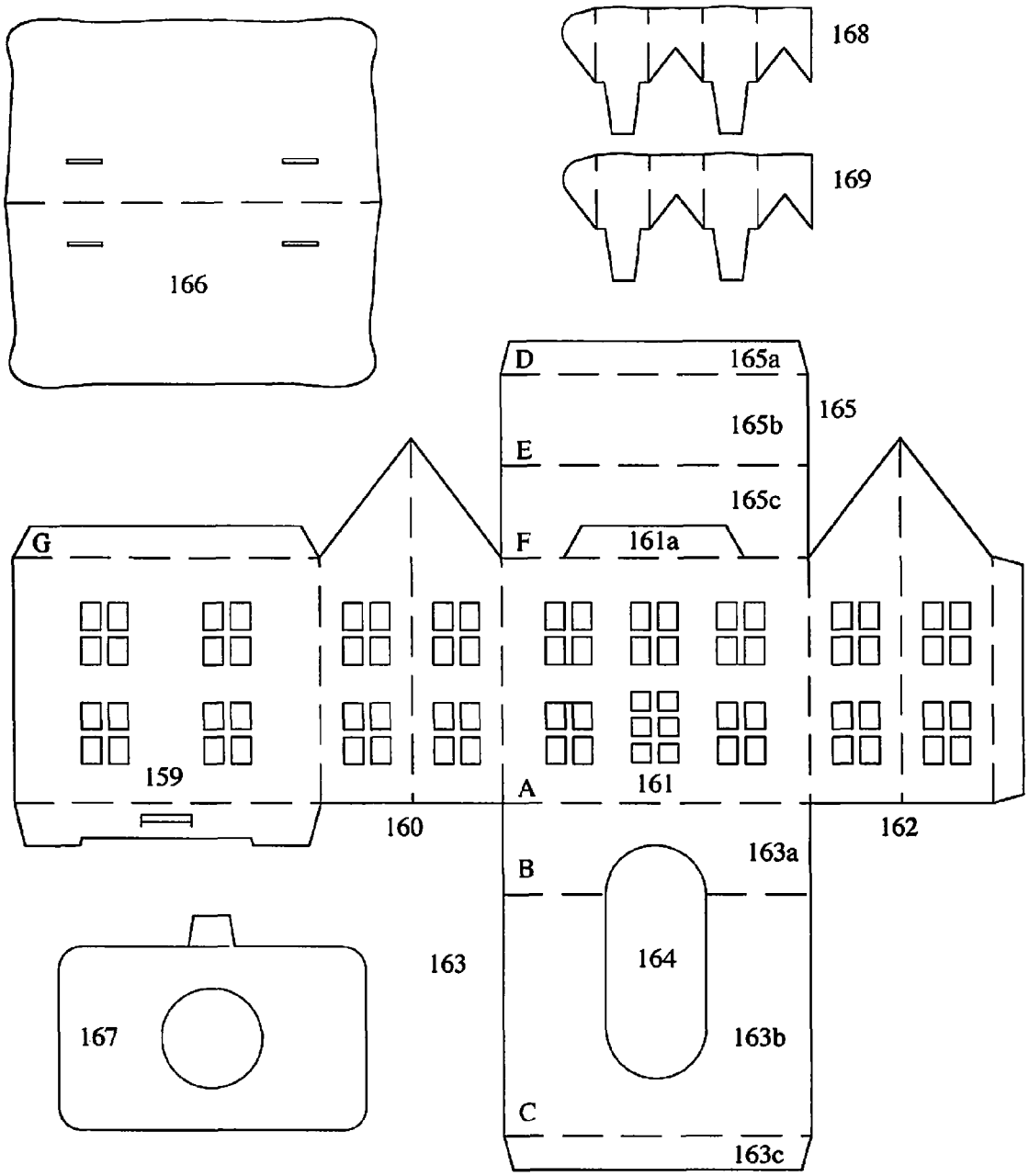
FIG. 8 is an example template showing the design and shape of various elements associated with a third example embodiment of a four-panel paper pop up structure that is consistent with the principles of the invention.

FIG. 8 shows an alternative embodiment of the four-panel paper pop up structure that is consistent with the principles of the invention. The assembly is similar in manner to the example embodiment of FIG. 6 with the following variations: the center internal support structure (163) is an extension of the bottom front wall panel and the spreader (165) is an extension from the top front wall panel. Die cutting the template in this manner eliminates two extra glue tabs while maintaining the integrity of the assembly as described. Note the window panes in this alternative embodiment are cut into the template. This is purely for alternative aesthetics and does not affect application of the internal vellum pieces nor the function of the assembly.

The alternative embodiment is assembled as described with regard to FIG. 6 with the following alterations to the method of assembly. Center internal support 163 is folded at score A back and behind front wall panel 161 whereby tab 163*c* is aligned and attached to spreader 164 just off center of score E on part 164*b*. As in FIG. 6, spreader tab 165*a* is attached just below score G on back wall panel 159. Top front wall tab 161*a* is attached to roof 166 as with regarding to the example embodiment of FIG. 6.

Figure 9:
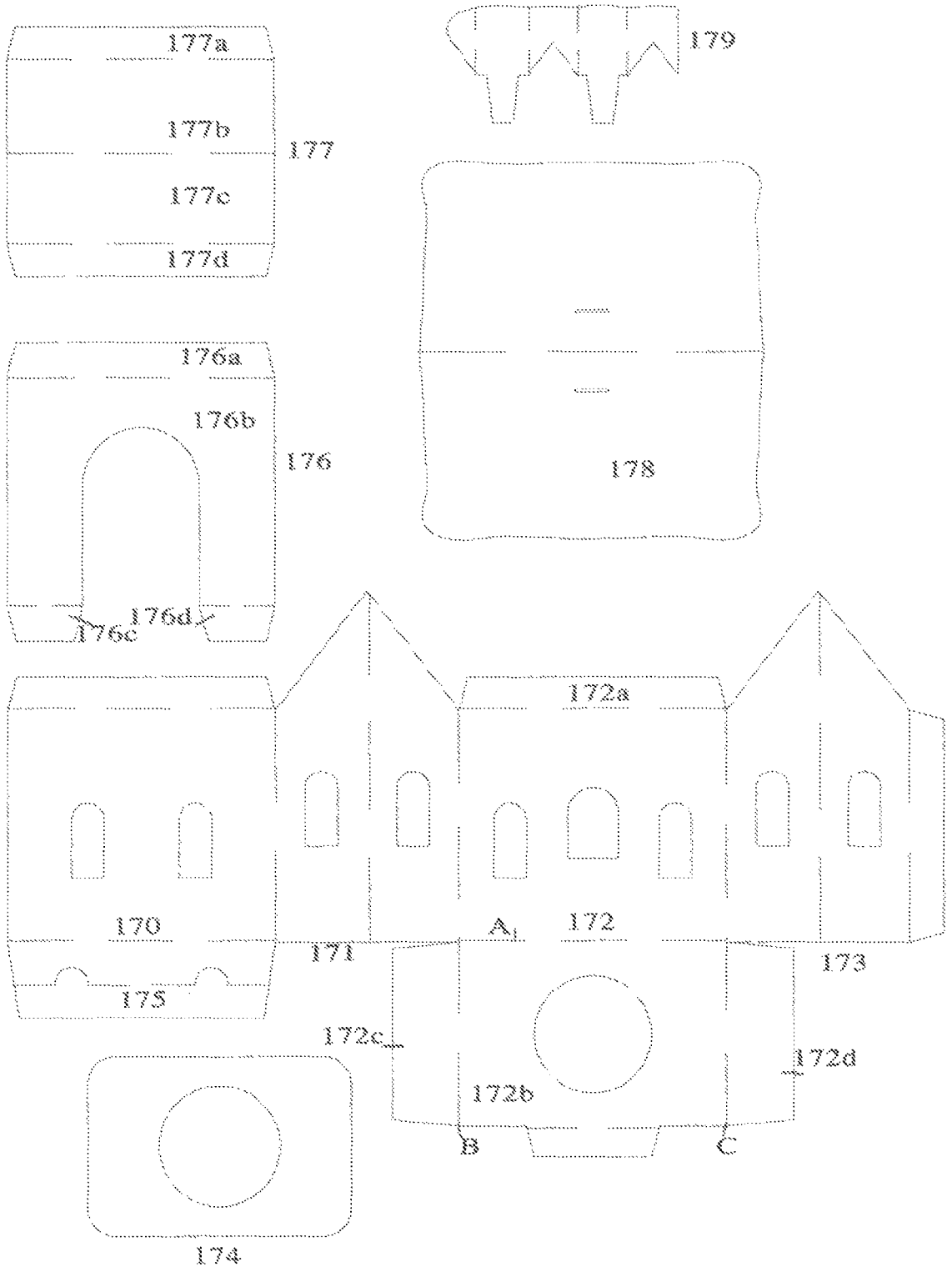
FIG. 9 is an example template showing the design and shape of various elements associated with a fourth example embodiment of a four-panel paper pop up structure that is consistent with the principles of the invention.
Figure 9:
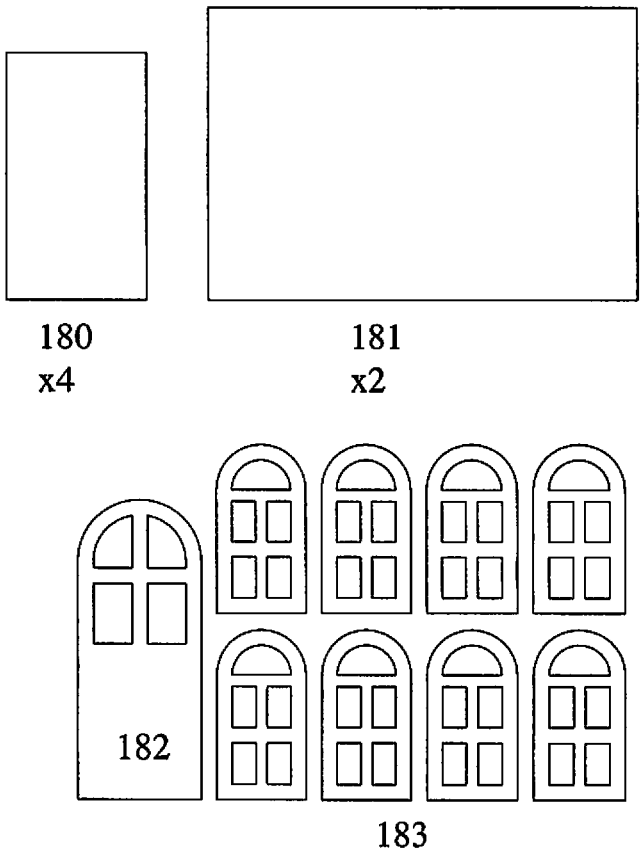

FIG. 9 shows an alternative embodiment of the four-panel paper pop up structure that is consistent with the principles of the invention. The assembly is completed in a similar manner regarding the example embodiment shown in FIG. 6 with the following variation: the base being an extension of front wall panel 172 with added tabs 172*c* and 172*d* and optional base plate 174. The alternative embodiment is assembled as described with regard to FIG. 6 with the following alterations to the method of assembly. The extended front wall panel base 172*b* is folded at score A back and behind front wall panel 172. Tabs 172*c* and 172*d* are folded at scores B and C to back side of extended base 172*b* and attached. The center support structure tabs 176*a* and 176*b* are attached to reference scores at ZZ on the extended base. The additional base plate 174 is optional and attached to base extension 172*b*.

The assemblies described herein may be made of a variety and combination of materials typically suitable for making pop up structures such as paper cardstock, light sheet plastic, Vellum (for transparent portions such as windows), vinyl and other materials known in the industry. In a preferred embodiment, structural elements of the inventive assembly are made of paper cardstock due to its natural rigidity and ability to fold. The stiffness of the cardstock aids in keeping the shape of a structure in its open (i.e. three-dimensional) second position while still allowing the structure to fold into the closed (i.e. flat) first position. For example, the paper cardstock used for the four wall panels for the depicted example embodiments preferably ranges in caliper from 10 to 14 points. The caliper of the internal center support structure is preferably 12 points with a vertical grain. Since the base has a center cut-out circle measuring in diameter of 1.5625 inches, allowing for an external light source to be used, and since a minimum caliper is needed on the base to be able to pull down and hold the internal support structure without bending or breaking the material during this action, the preferred caliper of the material used on the base is 0.024 inches or 24 points. While the several depicted example embodiments involve a square or rectangular three-dimensional structure (such as a house or church design), other embodiments may contain three-dimensional structures having more or fewer panels, different sizes, and/or different shapes. The embodiment of an alternative assembly in the shape of an angel, for example, may have only two exterior wall panels whereas the church and house shaped assemblies have four. A two or three dimensional tree design may have three-dimensional pop up ornaments attached thereto etc.

As the size of the structure increases, so shall the caliper of material in order to accommodate the structural requirements associated with keeping a larger (more heavily weighted) assembly.

The decorative overlays can be comprised of many types of materials since they are decorative and generally do not affect the structural integrity of the assembly. However, decorative overlay materials should be somewhat flat in appearance so as not to hinder the first folded flat position. Again, materials such as Vellum which provide translucence may be more appropriate than cardstock or paper in certain areas depending on design. The thickness of the cardstock at the base allows for built-in lighting to be manufactured directly into the base with a battery power source and on and off switch.

The invention uses a method of opening and closing the pop up assembly by pulling on the paper when it is traditionally pushed and pushing on the paper when it is traditionally pulled. This opposing method is accomplished by attaching the center support to a cardstock base that can fold up inside the pop up. By using the combination of a center support attached to internal base the invention is reversing the motion of a traditional pop up while still being able to create a three-dimensional object. The invention opens by pulling down from the center opening in said base which in turn pulls the spreader and opens the walls. The tab on the base then slips into a double folded slot located at the bottom of one wall of the pop up. This tab-slot design allows the pop up to hold its second position shape without the need for an extended base or the need for the end user to hold it open. A battery operated tea light or similar light can be placed in the opening in the base. To close, the said base tab is removed from the slot and pushed up inside the pop up thereby returning the walls to a folded flat position. As a result, this pushing action on the paper is returning the paper to its normal state of being flat. Unlike traditional pop ups, no additional support tabs are needed on the center support. The invention can accomplish a three dimensional pop up using an opposing motion made possible by combining the internal structure with a cardstock base.

The inventive assembly and method described herein offers several advantages over traditional three-dimensional pop ups assemblies.

The inventive assembly encompasses a method of opening and closing in a way that is counter to traditional pop ups by using an internal two story engineering design in combination with an internal base. This allows the base to fold into the pop up making it a complete and independent self contained unit maintaining the integrity of its intended size in the folded flat and open positions without an external base or any protruding mechanisms.

The inventive assembly uses a combination base tab and slot design with a heavy cardstock base combined with an internal structure which allows the pop up to stay open once the tab is placed into the slot. The rigidity of the heavy cardstock base makes it strong enough to anchor the center internal support without bending or buckling. The combination base tab allows for the assembly to remain in the open position without the aid of the end user. The heavy cardstock base provides the weight and rigidity necessary to pull down and hold the center internal structure while in the tab slot position.

The inventive assembly uses a base tab and slot design with a heavy cardstock base thereby eliminating the need for a large external base.

The inventive assembly allows for a light source to be used to illuminate the assembly.

The inventive assembly takes up less storage space due to the unique internal engineering design which eliminates the need for an extended base and/or protrusion. The inventive assembly has an authentic and esthetically pleasing shape due to the combination internal structure and internal base design.

The internal base and center support design makes the inventive assembly more compact in size and thus takes up less retail space than other decorative assemblies similar in nature. Because the aesthetics of the inventive assembly can be viewed in the fold flat position, it can be displayed individually in a flat position or as a set in a stationery-like box. Further, the inventive design eliminates the need for significant retail space for display or storage of the invention.

The internal base and center support design makes the invention compact in size allowing for easy storage by the end user.

The internal base and center support design which eliminates the need for an extended base or protrusion makes it easier to mail as a gift or promotional item.

The elimination of the extended base and/or protrusion means that fewer materials are used in the fabrication and thus the inventive assembly is less expensive to make than prior art assemblies.

The ability of the invention to move from a folded flat position to a three-dimensional position inclusive of decorative overlays and carefully designed and esthetically pleasing details makes for a novel and visually interesting product.

The base design allows the pop up structure to fold inward into the pop up creating a self-contained, stand-alone, three-dimensional pop up object that can fold flat for easy storage.

The present invention has now been described with reference to several embodiments thereof. The entire disclosure of any patent or patent application identified herein is hereby incorporated by reference. The foregoing detailed description and examples have been given for clarity of understanding only. No unnecessary limitations are to be understood therefrom. It will be apparent to those skilled in the art that many changes can be made in the embodiments described without departing from the scope of the invention. For example, the different external structure designs and dimensions for the same may be varied.

Further, the steps used to describe the method for making the various example embodiments may be performed in different order and the number of steps may differ depending on the complexity (i.e. number of elements) associated with each example structure. Thus, the scope of the present invention should not be limited to the structures described herein, but only by the structures and methods described by the language of the claims and their equivalents.

What is claimed is:

1. A stand alone pop-up assembly comprising:

an outer structure having two or more panel walls connected with a support structure wherein the support structure is an internal base which is permanently attached at one end with the outer structure and temporarily attachable at another end with the outer structure using temporary attachment means, wherein the assembly is moveable between a first position being folded closed into a one dimensional structure and a second position enfolded into a three dimensional structure by only manipulating the outer structure and the support structure, and the support structure is contained within the two or more panel walls of the outer structure when in the first position.

2. The pop up assembly of claim 1 wherein the support structure does not extend beyond the panel walls of the outer structure when the assembly is in the second position.

3. The pop up assembly of claim 1 wherein the support structure is configured to hold the outer structure in place when the assembly is in the second position.

4. The pop up assembly of claim 1 wherein at least one of the two or more panel walls of the outer structure is visible when the assembly is in the first position.

5. The pop up assembly of claim 1 wherein the support structure is comprised of a center support element connected at one end with a spreader and at the opposite end with an internal base configured for attachment with one or more panel walls.

6. The pop up assembly of claim 5 wherein the assembly may be temporarily secured in the second position by placing one or more tabs extending from the internal base into one or more corresponding pockets extending from the two or more panel walls.

7. The pop up assembly of claim 5 wherein the assembly may be temporarily secured in the second position by placing one or more tabs extending from the internal base into one or more corresponding slots in the two or more panel walls.

8. The pop up assembly of claim 5 wherein the center support element is attached to immediately adjacent a center fold line of the spreader to enable the spreader to fold flat when the assembly is in the first position.

9. The pop up assembly of claim 5 wherein the center support element is made of cardstock 12 points in caliper with vertical grain.

10. The pop up assembly of claim 5 wherein the internal base is made of cardstock 24 points in caliper.

11. The pop up assembly of claim 1 wherein the support structure is adapted for placement of one or more lights within the outer structure to light one or more portions of the assembly when the assembly is in the second position.

12. The pop up assembly of claim 1 wherein the outer structure consists of two or more panel walls covered by a roof.

13. The pop up assembly of claim 1 made from materials comprising one or more of paper card stock, vellum, light sheet plastic, and vinyl.

14. The pop up assembly of claim 1 wherein the panel walls are made of card stock ranging in caliper from 10 to 14 points.

15. A pop up assembly of claim 1 in the shape of any one of a house and a church.

16. A pop up assembly of claim 15 having overlay windows.

17. A pop up assembly of claim 1 wherein only one of the panel walls of the outer structure is connected with the internal base when the assembly is in the second position.

18. A method for making a pop up assembly having an outer structure with two or more panel walls connected with a support structure having a central support member connected at one end with a spreader and at the other end with an internal base wherein the support structure is configured to fold inside the panel walls of the outer structure when the assembly is moved to a position wherein the assembly is substantially three dimensional to a position wherein the assembly is substantially flat comprising the steps of:

attaching the two or more panel walls to create an outer structure, attaching the center support element at one end with the spreader and at the opposite end with the internal base to create a support structure, attaching the outer structure with the support structure by connecting the spreader with the two or more panel walls and one end of the internal base with one of the two or more panel walls such that the internal base does not extend beyond the walls of the outer structure when the assembly is in the second position and the internal base folds within the outer structure when the assembly is in the first position, attaching another end of the internal base with the outer structure using temporary anchoring means to secure the assembly in the second position.

19. A stand alone pop-up assembly comprising an outer structure having two or more panel walls connected with an internal support structure having a center support element connected at one end with a spreader and at the opposite end with an internal base configured for attachment with one or more of the two or more panel walls, wherein the assembly is moveable, without attachment of any gatefold base with the outer structure or internal support structure, between a first position wherein the assembly is folded substantially flat and a second position wherein the assembly is enfolded into a three-dimensional structure, wherein the assembly is moved into the second position by pulling down on the center support element to pull open the spreader and spread the walls and attaching temporarily securing the internal base to the base of the one or more or the two or more walls using temporary attachment means, and wherein the assembly is moved into a first positon by disengaging the internal base from the one or more of the two or more walls by disengaging the temporary attachment means and pushing the internal base up inside the walls to fold flat.

20. A method for making and using a stand alone pop-up assembly comprising the steps of:

(a) providing an outer structure by connecting two or more panel walls to a support structure, wherein the support structure is an internal base;

(b) permanently attaching one end of the internal base with one end of the outer structure;

(c) manipulating the assembly into a first position by folding the assembly closed into a one dimensional structure by only manipulating the outer structure and the support structure, and the support structure is contained within the two or more panel walls of the outer structure when in the first position; and (d) manipulating the assembly into a second position, enfolded into a three dimensional structure by only manipulating the outer structure and the support structure, (e) providing means temporarily attaching a second end of the internal base with a second end of the outer structure when in the second position.

* * * * *